US008572813B2

(12) United States Patent
Monaco

(10) Patent No.: US 8,572,813 B2
(45) Date of Patent: Nov. 5, 2013

(54) FIXED LOOP FILAMENT KEY RING FOR LUGGAGE AND VEHICLE KEYS AND TAGS WITH PERMANENT LOCKING FEATURE

(76) Inventor: William Monaco, Loxahatchee, FL (US)

( * ) Notice: Subject to any disclaimer, the term of this patent is extended or adjusted under 35 U.S.C. 154(b) by 40 days.

(21) Appl. No.: 13/252,586

(22) Filed: Oct. 4, 2011

(65) Prior Publication Data

US 2012/0260705 A1 Oct. 18, 2012

Related U.S. Application Data

(60) Provisional application No. 61/389,406, filed on Oct. 4, 2010.

(51) Int. Cl.
*G09F 3/14* (2006.01)
*A44B 15/00* (2006.01)

(52) U.S. Cl.
USPC ..... 24/16 PB; 40/665; 70/457; 70/458

(58) Field of Classification Search
USPC ..... 24/16 R, 17 A, 17 AP, 16 PB, 30.5 P; 248/74.3; 292/319–321, 325, 307 A; 40/300–305, 633, 665; 70/457, 458
See application file for complete search history.

(56) References Cited

U.S. PATENT DOCUMENTS 2,871,691 A * 2/1959 Bacon ..... 70/458
2,979,794 A * 4/1961 De Bartolo ..... 24/17 R
3,146,012 A * 8/1964 King, Sr. ..... 292/320
3,718,355 A * 2/1973 Canter ..... 292/321
4,106,802 A * 8/1978 Lozio ..... 292/320
4,507,828 A * 4/1985 Furutsu ..... 24/16 PB
4,559,676 A 12/1985 Paradis
4,946,210 A 8/1990 Fuehrer
4,951,362 A * 8/1990 Denemark et al. ..... 24/16 PB
5,056,837 A 10/1991 Fuehrer
5,364,141 A 11/1994 King
5,636,412 A 6/1997 Lodi et al.
5,836,054 A * 11/1998 Alexander ..... 24/16 PB
6,640,394 B1 11/2003 Berrocal et al.
6,981,725 B2 * 1/2006 Debrody et al. ..... 292/307 R

* cited by examiner

*Primary Examiner* — James Brittain
(74) *Attorney, Agent, or Firm* — Ober, Kaler, Grimes & Shriver; Royal W. Craig

(57) ABSTRACT

A fixed-loop key ring having an elongated filament with a barrel-shaped head at one end and a locking element at the opposite. Engagement of the locking element in the head forms a nearly circular loop for retaining one or more objects through their eyelets. The barrel-shaped head has a longitudinal bore of decreasing width that intersects a lateral channel entering from the top of the barrel, creating a step at the bore-channel interface. The locking element may be a bifurcated tip with a tapered distal end defined by opposing steps flanking a notch, the notch/steps compressing when inserted into the bore to permit the tapered portion to pass through and into the lateral channel, yet inhibiting withdrawal when engaged to the step inside the barrel-shaped head. A flat-bladed tool may plastically deform the locking element for permanent engagement via insertion between the bifurcations through the lateral channel.

1 Claim, 2 Drawing Sheets

KEEP WINDOW
ON THE INSIDE
21
25
41
15

USE EXPANDER
FOR EXTRA HOLD
50
53
52

27a
27b 41
15
28a
28b
26
25
15

10
20
41

FIXED LOOP FILAMENT KEY RING FOR LUGGAGE AND VEHICLE KEYS AND TAGS WITH PERMANENT LOCKING FEATURE

CROSS-REFERENCE TO RELATED APPLICATIONS

The present invention derives priority from U.S. provisional application 61/389,406 filed 4 Oct. 2011.

BACKGROUND OF THE INVENTION

1. Field of the Invention

The present invention relates generally to key rings and more specifically to fixed diameter irreversible loop ties for permanently securing vehicle and luggage keys and Tags.

2. Description of the Background

Ties such as cable ties and the like are well known and widely used to bundle small items such as cables and wires, and are often used to attach and secure various items together such as tags to products or even products within packaging. Common cable ties are characterized by a flat nylon track having a series of transverse teeth along a portion of one surface. At one end of the track a head is provided with an aperture through it. Within the aperture is a pawl positioned to engage the teeth when the opposite end of the track is looped over and advanced through the aperture thereby preventing the track from being withdrawn. The track can be advanced further through the aperture to tighten the tie (i.e. reduce the diameter of the loop) but cannot be withdrawn under normal circumstances to increase the loop diameter or open the loop altogether. The tie cannot be removed without cutting the track. Notably the aperture through the head is orthogonal to the longitudinal direction of the track such that the loop cannot be continuously circular but rather has at least one point characterized by a discrete angle. Such ties are sometimes referred to as zip ties in reference to the sound made by the pawl advancing over the teeth of the track. Such ties are not well suited for use as a key ring because the teeth interfere with access to the keys. The inability of the keys to rotate freely about the ring is further exacerbated by the oversized, rectilinear head and the discrete angle created by the orthogonal orientation of the head aperture relative to the track.

There are a variety of fixed loop ties that engage to establish a set loop diameter. For example, U.S. Pat. No. 4,559,676 to Paradis is such a fixed loop tie. Other ties include those disclosed in U.S. Pat. No. 6,640,394 to Berrocal et al., U.S. Pat. 5,636,412 to Lodit et al., U.S. Pat. No. 5,364,141 to King, and U.S. Pat. Nos. 4,946,210 and 5,056,837 to Fuehrer. Unfortunately, the self-locking engagement in the foregoing comprises a fixed stop that is either too big to fit through the aperture of a key, or not secure enough to prevent opening. Rental car and leasing companies demand an inexpensive key ring that can only be opened by cutting through it. This in turn requires a highly reliable locking mechanism in as small and compact a footprint as possible. While each of the prior art patents provides a partial solution to the problem, none resolve the problem addressed by the present disclosure. Specifically, it would be advantageous to provide a fixed loop key ring having a filament loop having on one end an inline barrel head and on the other a cooperative locking element that is quickly and easily secured in the barrel head to form a continuous, circular loop. It would further be advantageous that the head and locking element have a low profile to permit objects captured on the loop to move freely around the loop without getting hung up at any particular point. It would be further advantageous to provide a head and cooperative locking tool for permanently deforming and thereby securing the locking element within the head.

SUMMARY OF THE INVENTION

In accordance with the foregoing objects and advantages, the present invention discloses a fixed loop key ring having an elongate filament with a distal barrel head at one end and, at the other end, a locking element for cooperative insertion and engagement in the barrel to form a circular or nearly circular smooth loop of uniform diameter on which one or more keys may be freely retained. The barrel shaped head configuration lends itself to a two-part molding process which results in a longitudinal bore of decreasing width intersected by a lateral channel entering from the top of the barrel, the lateral channel being wider than the tapered width of the longitudinal bore, a step is created at the bore-channel interface. The locking member is provided with a bifurcated tip having tapered distal ends joined by a bridge, the tapered portion ending abruptly to form a step. When inserted into the bore the bifurcated tip is compressed permitting the taped portion to pass through the bore and into the lateral channel where the step and the two steps engaging to inhibit withdrawal. A tool having a flat blade is provided for insertion between the bifurcations via the lateral channel to plastically deform the locking element for permanent engagement.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figures 1, 2, 3, 4:
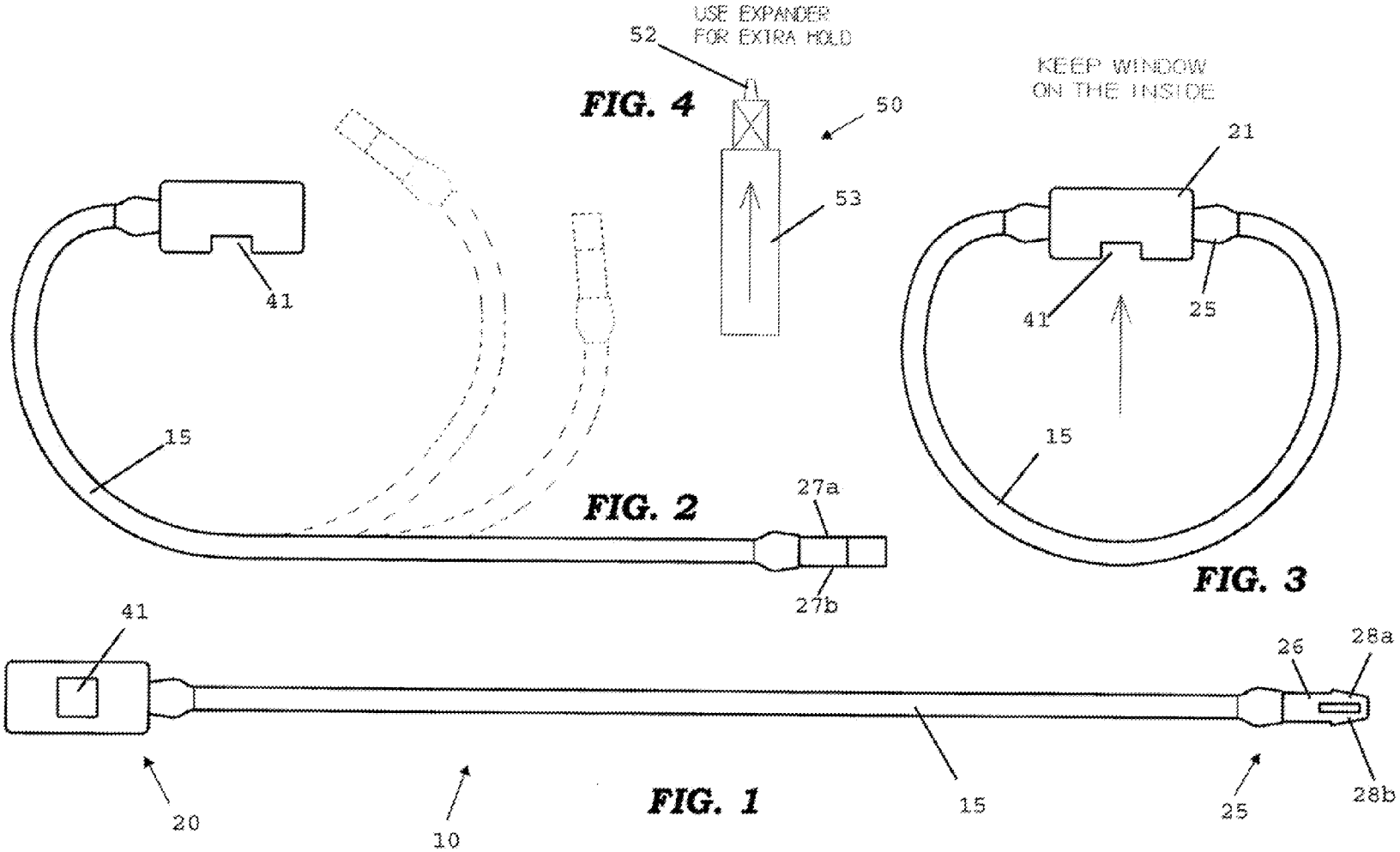
FIG. 1 is a top view of a key ring according to the present invention in the unlocked position.
FIG. 2 is a side view of a key ring according to the present invention in the process of being looped back on itself and locked.
FIG. 3 is aside view of a key ring according to the present invention in the locked position.
FIG. 4 is a view of an expander for locking the key ring.

With reference to FIG. 1, the present invention discloses a fixed loop key ring 10 in the form of an elongate filament 15 having at one end a barrel head 20 and at the opposing end a locking element 25 for cooperative insertion and engagement in the head 20 to form a circular or nearly circular loop (See FIG. 3) of certain diameter, and upon which one or more vehicle or luggage keys and/or identification tags may be freely retained by their eyelet or hole.

Though the invention provides special utility in the context of vehicle or luggage keys and/or identification tags, one skilled in the art will readily understand that the invention can be used in other contexts without departing from the scope or spirit of the invention. For example, retail stores may use the device for securing pairs of shoes together, for securing RFID or other security tags to products, or for generally securing associated products together or products to store fixtures.

The length of the intermediate filament 15 is determined by the ultimately desired loop diameter, as will become apparent. The cross section of the filament is preferably circular (as in FIG. 5) but may be ovoid, rectangular or rounded rectangular. It is preferable the cross sectional area of the filament be compact and circular-symmetrical about its longitudinal axis, not flat as in the form of a ribbon. While flat track type ties may be suitable for tightly wrapping about a group of objects as in a bundle of wires, such flat tracks are not suitable for use with eyelets or holes in small objects such as tags or keys. The preferred filament does not impede the motion of retained objects and may be made of nylon or another suitable polymer along with the other components of the fixed loop key ring 10. Alternately, the fixed loop key ring 10 may be constructed of metal such as stainless steel or as a combination of polymer and metallic components.

The locking element 25 at one end of the filament 15 is an elongate member 26 enlarged relative to the cross section of the filament and characterized by opposing planar upper and lower surfaces 27*a* and 27*b*, respectively. The distal portion of the elongate member 26 is bifurcated into left and right lateral portions 28*a* and 28*b*, respectively along the vertical plane connecting the upper surface 27*a* and the lower surface 27*b*. Importantly, the medial channel 29 between the left and right lateral portions 28*a* and 28*b* has a non-zero width (i.e. is more than a slit) and is preferably 0.5 mm to 1.5 mm. In a preferred embodiment the distal tip of the left lateral portion and the right lateral portion 28*a* and 28*b* are joined by a bridge element 30 across the medial channel 29.

Figure 5:
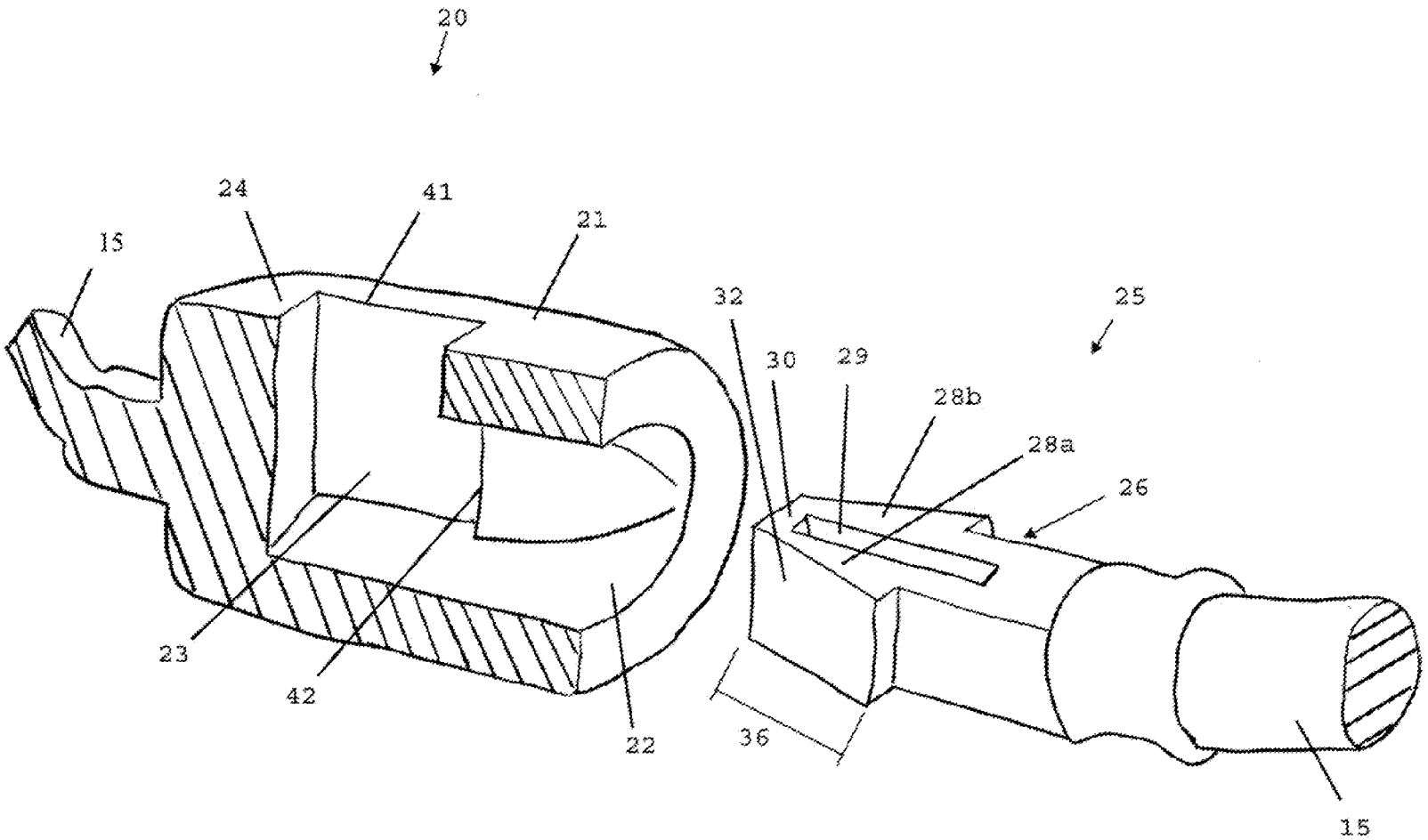
FIG. 5 partial sectional view of the head of a key ring according to the present invention in proximity to the cooperative locking element.

With continued reference to FIG. 1 and additional reference to FIG. 5, the left and right lateral portions 28*a* and 28*b* of the distal, bifurcated portion of the locking element 25 have opposing lateral surfaces 32 joining the upper surface 27*a* and the lower surface 27*b*. Each lateral surface 32 is characterized by a region of continuously increasing width extending from the bridge element 30 toward the point of bifurcation. In a preferred embodiment, the region of continuously increasing width extends approximately midway to point of bifurcation and results in a tapered portion 36 of the locking element having a wedge shaped profile with respect to the vertical plane.

Again with reference to FIGS. 1 and 5, the end of the filament 15 opposite the locking element is provided with a preferably integrally formed head 20. Importantly, head 20 is an elongate substantially cylindrical barrel 21 having a circular cross section and rounded (or beveled) cylinder edges so as not to impede the free motion of objects retained on the key ring. Head 20 is defined by a longitudinal axis at least parallel with that of the filament 15 to and preferably coaxial therewith. The axial end of the barrel 21 opposite the filament 15 is characterized by a preferably circular bore 22. The depth of the bore 22 is preferably sufficient to receive entirety of the elongate member 26. The diameter of the bore 22 at the axial end of the barrel is approximately equal to the maximum width of the tapered portion 36 of the locking element 25.

Although externally rounded, the barrel 21 is defined by a top portion 24 denoted by a preferably rectangular aperture 41 extending vertically down into the barrel 21 to form a lateral slot 23. The lateral slot 23 intersects the bore 22 within the barrel 21. The dimension of the lateral slot 23 in the axial direction of the barrel 21 is equal to or preferably slightly greater than the length of the tapered portion 36 of the locking element 25. The dimension of the lateral slot 23 in the horizontal plane through the barrel 21 is equal to or preferably slightly greater than the maximum width of the tapered portion 36 of the locking element 25. The bore 22 is tapered from its diameter at the axial end of the barrel on two sides in the vertical plane until the bore 22 intersects the lateral slot 23 at which point the taper abruptly ceases producing a step 42 on either side of the bore 22 where the bore meets the lateral slot 23. The taper is such that the minimum dimension of the bore 22 at the steps 42 is approximately equal to or slightly greater than the maximum width of the tapered portion 36 of the locking element 25 less the width of the medial channel 29.

With reference to FIGS. 1, 2, 4 and 5, the fixed loop key ring 10 is utilized by bending the filament 15 upward such that the top portion 24 of the barrel 21 upper surface 27*a* of the elongate member 26 are brought toward one another (as in FIG. 2) such that the longitudinal axis of the elongate member is aligned with the longitudinal axis of the barrel 21. The elongate member 26 is then inserted into the barrel 21 where the lateral surfaces 32 of the tapered portion 36 of the locking element 25 engage the tapered portion of the bore at which point the left and right lateral portions 28*a* and 28*b* are deformed and compressed into the medial channel 29 to permit passage of the tapered portion 36 into the lateral slot 23. Once within the lateral slot 23 the With reference to FIG. 4, a tool is provided the left and right lateral portions 28*a* and 28*b* of the locking element 25 largely return to their original shape making withdrawal of the locking member 25 from the barrel 22 difficult due to engagement of the stepped lateral surface 32 with wall of the lateral slot 23 where the taper of the bore 22 ends. This engagement forms the filament 15 into a closed loop having no included angles and permitting captured items to freely move about the loop without impediment. If more permanent locking of the loop is or becomes desired, an expander tool is provided for this purpose.

With reference to FIG. 4, an expander 50 is depicted having a blade tip 52 and a handle 53. The blade tip 52 is generally planer and sized to fit in the medial channel 29 of the locking element 25. In use the blade tip 52 is inserted into the medial channel 29 via the lateral slot 23 which provides an access window to the medial channel. The handle 53 of the expander 50 is rotating causing the blade to rotate in the medial channel and deform the left and right lateral portions 28*a* and 28*b*. The bridge 30 joining the distal tips of the left and right lateral portions 28*a* and 28*b* causes the deformation to occur at or near the end of the tapered portion (and closer to the point of bifurcation). This maximizes engagement of the of the stepped lateral surface 32 with wall of the lateral slot 23 where the taper of the bore 22 ends preventing pullout and increases the force necessary to deform the locking element ensuring that plastic deformation occurs to permanently secure the locking element in the barrel.

Having now fully set forth the preferred embodiments and certain modifications of the concept underlying the present invention, various other embodiments as well as certain variations and modifications thereto may obviously occur to those skilled in the art upon becoming familiar with the underlying concept. It is to be understood, therefore, that the invention may be practiced otherwise than as specifically set forth herein.

I claim:

1. A fixed loop key ring for loosely retaining pieced objects, comprising:

a filament having a first end and a second end;

a locking element engaged to said first end, said locking element comprising an elongate member having a bifurcated tip, each of said bifurcations separated by a medial channel and joined at their distal ends by a bridge element, said bifurcations further having a tapered portion of increasing width extending from said bridge element and toward said first end of said filament and ending abruptly to form a pair of opposing first steps; and a head engaged to said second end, said head comprising a barrel coaxially engaged to said filament and having a circular bore in its distal end, said circular bore being interrupted on two opposing sides by flat walls extending alongside an axis of said circular bore and converging inward toward each other as distance increases from said distal end to a pair of opposing second steps on either side of the circular bore, the inwardly tapering walls being spaced by a a minimum dimension at said step, a lateral rectilinear channel entering said barrel from a top surface and intersecting said bore perpendicular to its said axis, a width of said rectilinear channel measured perpendicular to the axis of said circular bore being greater than said minimum width of said tapered walls, the intersection of said bore and said channel forming said pair of opposing second steps, whereby said bifurcations are compressed into said medial channel when said locking element is inserted into said head so as to permit said tapered portion to enter said lateral channel via said bore, thereafter resuming their prior shape such that said pair of opposing first steps engage said pair of opposing second steps thereby inhibiting withdrawal of said locking element from said barrel.

* * * * *